United States Patent [19]

Andrew

[11] 4,216,820

[45] Aug. 12, 1980

[54] CONDENSER/EVAPORATOR HEAT EXCHANGER AND METHOD OF USING THE SAME

[75] Inventor: John E. Andrew, Renton, Wash.

[73] Assignee: The Boeing Company, Seattle, Wash.

[21] Appl. No.: 894,254

[22] Filed: Apr. 7, 1978

[51] Int. Cl.[2] ..... F28B 1/02; F28D 9/00; F28F 9/00

[52] U.S. Cl. ..... 165/1; 165/110; 165/115; 165/166; 165/174

[58] Field of Search ..... 165/110, 114, 115, 118, 165/166, 170, DIG. 8, 165, 1, 174, 171; 62/52

[56] References Cited

U.S. PATENT DOCUMENTS

| | | | |
|---|---|---|---|
| 1,610,651 | 12/1926 | Blaetz | 165/170 |
| 1,694,370 | 12/1928 | Burdick | 165/118 |
| 1,833,291 | 11/1931 | Kraenzlein et al. | 165/171 |
| 2,285,225 | 6/1942 | Norris | 165/170 |
| 3,211,219 | 10/1965 | Rosenblad | 165/166 |
| 3,808,104 | 4/1974 | Davidson | 165/166 |
| 3,913,667 | 10/1975 | Meylan et al. | 165/115 |
| 3,913,667 | 10/1975 | Meylan et al. | 165/115 |
| 3,995,663 | 12/1976 | Perry | 165/118 |
| 4,119,140 | 10/1978 | Cates | 165/115 |

*Primary Examiner*—Sheldon Richter
*Attorney, Agent, or Firm*—Hughes & Barnard

[57] ABSTRACT

A heat exchange apparatus comprising a plurality of vertically aligned modular panel units, positioned adjacent to one another in a closed housing. Each panel unit comprises a perimeter frame and a plurality of vertical spacing elements. Two sheets of thin film plastic are placed on opposite sides of each panel unit and define with the spacing units vertical passageways within the panel unit. An evaporating liquid heat exchange medium, such as brine, is directed into the upper ends of the passageways against the inside surfaces of the sheets to form a falling liquid film. A gaseous condensing heat exchange medium, such as steam, is directed into the areas between adjacent panels to cause condensation in the form of water on the outside surface of the thin film sheets.

9 Claims, 4 Drawing Figures

FIG. 2
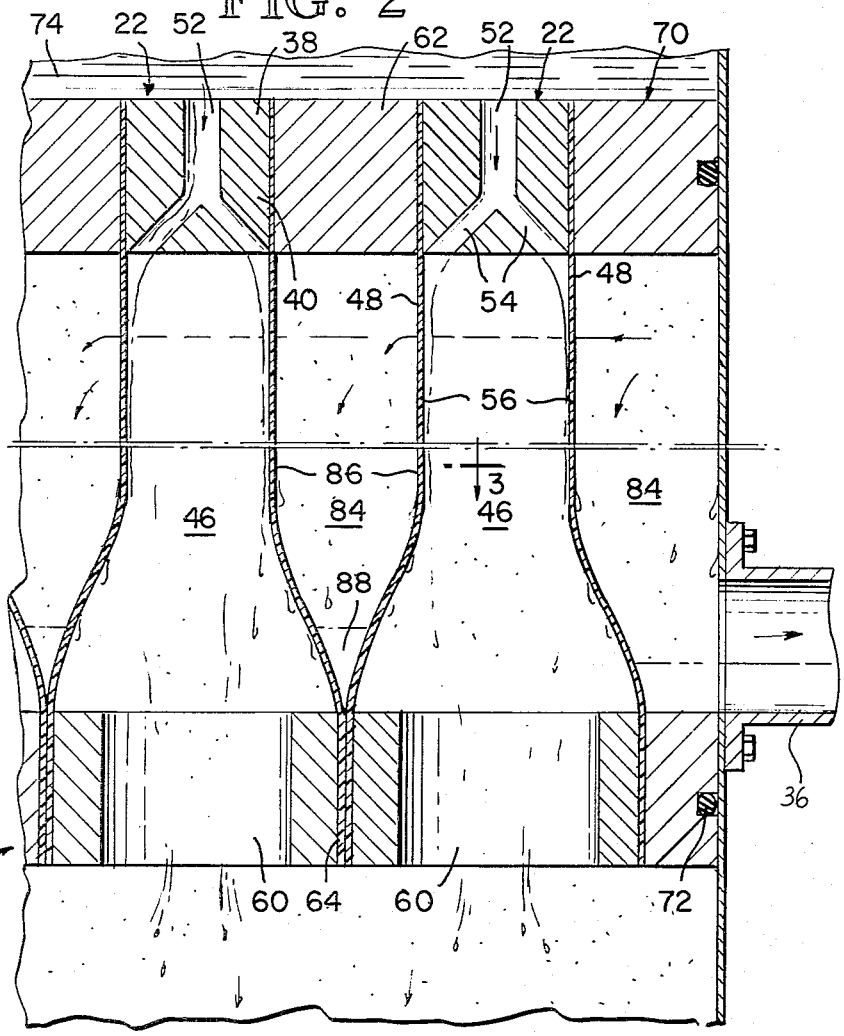
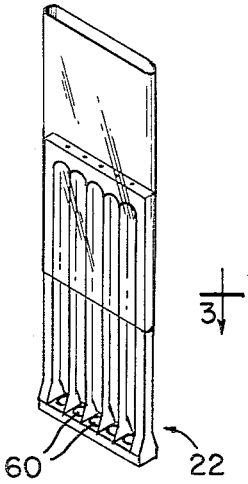
FIG. 4
FIG. 3
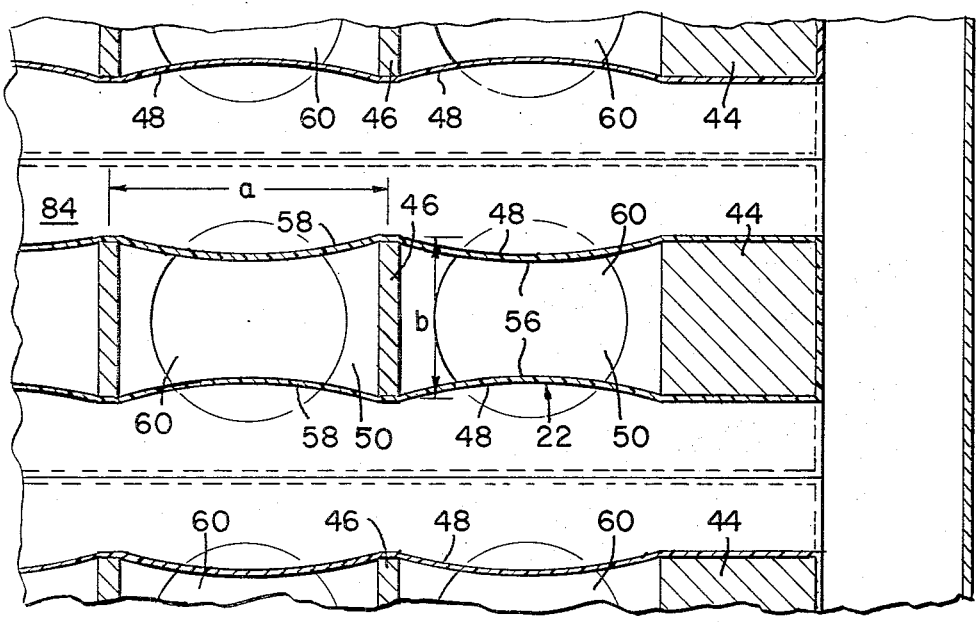

CONDENSER/EVAPORATOR HEAT EXCHANGER AND METHOD OF USING THE SAME

BACKGROUND OF THE INVENTION

1. Field of the Invention

The present invention relates to a condenser-/evaporator heat exchanger and a method of using the same.

2. Brief Description of the Prior Art

Since the present invention is well adapted for use in conjunction with heat exchange systems where saline or brackish water is converted to potable water, the general state of the prior art with regard to heat exchangers will be given consideration with reference to such systems. A common arrangement for such systems is to employ two distinct heat exchangers. The first heat exchanger is generally a counterflow heat exchanger and is used to place the brine which is initially flowing into the system in heat exchange relationship with the potable water flowing from the system to transfer the heat from the potable water to the incoming brine and raise its temperature from ambient temperature to a higher temperature, possibly in the order of 200° F. or so. The second heat exchanger is a condenser/evaporator type heat exchanger where the brine is pumped to the upper end of the heat exchanger and caused to fall as a thin film over one side of a set of heat exchange surfaces. At the same time, steam which is derived by heating the brine is compressed to a higher pressure and exposed to the opposite side of the heat exchange surfaces to be in heat exchange relationship with the brine film. This causes potable water to condense on the second set of surfaces and also causes evaporation of water from the brine flowing downwardly on the opposite side. This condensed water is collected and passed out through the first counter flow heat exchanger to raise the temperature of the incoming brine as described above.

In general, there have been two common arrangements for the elements which provide the heat exchange surfaces. One is to provide a plurality of plates arranged parallel to one another and spaced a short distance from each other, so that a plurality of adjacent passageways are formed by the various sets of plates; this is commonly called a flat plate heat exchanger. One heat exchange medium is directed through a first set of alternately spaced passages, while the second heat exchange medium is directed through the second set of passageways spaced intermittently with the first set. Thus, heat is transferred from one heat exchange medium to the other through the plates.

The second general arrangement for heat exchangers is to provide the heat exchange elements in the form of elongate tubes which extend through a heat exchange chamber and are spaced a moderate distance from one another. One heat exchange medium is directed into the interior of the tubes, while the other heat exchange medium is directed into the area between and around the outside of the tubes. In some instances, the second heat exchange medium flows in a direction transverse to the longitudinal axes of the tubes, and in other arrangements, the second heat exchange medium is directed parallel to the longitudinal axes of the tubes.

Since one of the main factors influencing the effectiveness of the heat exchanger is the heat transfer characteristics of the material separating the two heat exchange mediums, it has been quite common to fabricate the heat exchange elements from a metal which has a high thermal conductivity. However, for massive heat exchange installations, such as those used in producing potable water from saline water, the cost of providing and maintaining heat exchange elements in a quantity and size necessary to provide the heat exchange surface required, is a significant factor in determining whether the overall heat exchange system is economically feasible. This becomes particularly critical where metal is used as the material for the heat exchange elements, since the fabrication and installation of a vast number of metallic heat exchange elements can become a substantial portion of the cost of the entire system. Also corrosion of metallic surfaces can be a substantial source of maintenance costs.

Accordingly, there have been attempts in the prior art to fabricate the heat exchange elements from other materials, and one of the results is research and development work in thin plastic film heat exchangers. Since plastic, in comparison to metal used in heat exchangers, is a relatively poor conductor of heat, for such films to operate with reasonable effectiveness, it is necessary to make the films quite thin to obtain adequate transfer of heat. The result is that the film material is generally relatively flexible and fragile in comparison to comparable metal heat exchange structures. When the thin film plastic is arranged as planar sheets to form the heat exchange surfaces (in the general configuration of metal panels), it becomes difficult to maintain the sheets in proper spaced relationship with respect to one another. One of the reasons for this is that to operate the heat exchanger, either as a counterflow heat exchanger or an evaporative type heat exchanger it is generally necessary to have at least some pressure differential between the two heat exchange mediums.

It has also been attempted in the prior art to provide thin film plastic heat exchangers in the form of tubular heat exchange elements. This alleviates to some extent the problem posed by pressure differential between the heat exchange mediums, since the higher pressure heat exchange medium can be directed into the interior of the tubes which are then caused to assume a generally circular configuration in response to the internal pressure. However, for practical commercial operation, these tubes must be provided in relatively long lengths, and there are quite often problems of instability in the tubes oscillating or becoming positioned against one another in response to the influence of the flow of the heat exchange medium or mediums either through or around the tubes. Not only does this create problems in preserving the structural integrity of the heat exchange structure, but it also creates a problem in the optimization of the heat transfer characteristics of the heat exchanger.

With regard to the various heat exchange devices shown in the literature of United States patents, the following are noted:

U.S. Pat. No. 1,955,261, Tryon et al, shows a heat exchanger where there are a plurality of tubes which are arranged in an alternating pattern and cast into a block made of a suitable metal, such as aluminum or copper.

U.S. Pat. No. 2,347,957, McCullough, shows a heat exchanger comprising a tubular member arranged in a circuitous pattern and having a number of fins extending therefrom to improve heat transfer.

U.S. Pat. No. 3,161,574, Elam, shows a condenser type heat transfer device where thin film plastic tubes are used as the heat exchange elements. Pressurized steam is directed into the interior of the tubes, and brine is directed as a film over the outside surface of the tubes.

U.S. Pat. No. 3,315,740, Withers, shows a heat exchanger made up of a tube bundle. The ends of the tubes are gathered together in a manner to form a fluid tight end portion of the tubular heat exchanger.

U.S. Pat. No. 3,493,040, Davison, shows a plate-type heat exchanger where the plates are formed with dimples to provide for proper spacing of the plates.

U.S. Pat. No. 3,537,935, Withers, shows a heat exchanger formed with plastic tubes, with one heat exchange medium being directed through the tubes and the other heat exchange medium being directed along a path transverse to the lengthwise axis of the tubes, commonly called a crossflow heat exchanger.

U.S. Pat. No. 3,616,835, Laurenty, is generally representative of a flat plate type heat exchanger.

U.S. Pat. No. 3,790,654, Bagley, teaches a method of extruding thin-walled honeycombed structure. While the teaching of this patent is not directed specifically toward heat exchangers, it does state that such honeycomb structures are used in regenerators, recuperators, radiators, catalyst carriers, filters, heat exchangers and the like.

U.S. Pat. No. 3,825,460, Yoshikawa et al, shows a carbonaceous honeycomb structure where tubular-like elements are formed into a variety of structures having elongate passageways, some of which are triangular, some of which are circular, and some of which are hexagonal.

U.S. Pat. No. 3,926,251, Pei, shows a counterflow heat exchanger where circular tubes are laid down, then expanded into contact with one another. In one embodiment, the tubes are arranged in a pattern so that the end passageways are formed as squares. In another configuration the tubes are arranged so the the end configuration of the passageways are hexagonal.

U.S. Pat. No. 3,948,317, Moore, discloses glass-ceramic tubes which are formed into a honeycomb configuration for use as heat exchangers.

U.S. Pat. No. 3,983,283, Bagley, discloses a ceramic honeycomb structure for use as a catalytic converter or heat exchanger, U.S. Pat. No. 4,002,040, Munters, shows a cross-current heat exchanger, where an air-stream is cooled by evaporating moisture into a second air stream placed in heat exchange relationship with the first air stream.

U.S. Pat. No. 4,029,146, shows several configurations of a corrugated metal panel used as a heat exchanger.

The following patents are noted as broadly representative of various prior art devices: U.S. Pat. Nos. 2,820,744, Lighter; 3,168,450, Black; 3,239,000, Meagher; 3,367,843, Clive et al; 3,396,785, Kirsch; 3,428,529, Gumucio; 3,672,959, Sweet; 3,703,443, Evans; and 3,929,951, Shibata et al.

SUMMARY OF THE INVENTION

The heat exchange apparatus of the present invention is particularly adapted for use as a condenser/evaporator heat exchanger. This apparatus comprises a heat exchange section having a vertical axis, and horizontal "X" axis and a horizontal "Y" axis perpendicular to the "X" axis. The heat exchange section comprises a plurality of heat exchange panel units, with each panel unit comprising a mounting frame aligned generally in a plane aligned with the vertical axis and the "X" axis. The mounting frame comprises a perimeter portion and a plurality of vertically extending spacing elements, spaced from one another at generally regular intervals along said "X" axis. A pair of thin film sheets having inner and outer surfaces are positioned on opposite sides of the mounting frame. The inner surface of the sheets defines with the frame vertical passageways within the panel unit.

The panel units are positioned adjacent one another so as to be spaced moderately from one another at generally regular intervals on the "Y" axis. Each adjacent pair of panel units defines therebetween a condensing area. There is means to direct a pressurized gaseous condensing medium into the condensing area between the panel units. There are other means to direct a liquid evaporating medium as liquid films onto the upper ends of the inner surfaces of the sheets. This results in heat exchange taking place between the two mediums across each sheet.

In the preferred form, the perimeter frame comprises upper, bottom and side members, with each of the upper members having a plurality of inlet ports. Each inlet leads into a related passageway to permit the liquid medium to be directed into such passageways. Each of the bottom frame members is provided with outlet ports, each leading from a related passageway to permit outflow of the liquid medium and outflow of the gas from the evaporating surface.

There are a plurality of spacing blocks positioned between the panel units at least at one of the upper and lower ends of panel units. The spacing blocks form with the panel units a partition to confine the condensing medium located in the area between adjacent pairs of the panel units. In the preferred form, the spacing blocks are provided at the upper end of the panel unit, and at its lower end of the panel itself is enlarged to allow outlet holes large enough to pass the liquid gas mixture.

In the preferred embodiment, the spacing elements in each panel are spaced from one another along the "X" axis at a distance of about one to three inches, and desirably between about 1½ to 2½ inches. The spacing elements have a dimension along the "Y" axis about one to three inch and desirably between about 1½ to 2½ inch.

In the method of the present invention, an apparatus is provided, such as that indicated above. The pressurized gaseous medium is directed into the condensing areas between the panel units. The liquid evaporating medium is directed as liquid film onto the upper ends of the surfaces of the sheets.

Other features of the present invention will become apparent from the following detailed description.

BRIEF DESCRIPTION OF THE DRAWING

FIG. 2 is a sectional view taken along line 2—2, showing the upper and lower portions of the heat exchange apparatus, with the central portion of the heat exchanger being broken away; and FIG. 3 is a sectional view taken along line 3—3 of FIG. 2;

FIG. 4 is an isometric view illustrating a panel unit with the plastic sheet envelope partially removed from the panel frame for purposes of illustration.

DESCRIPTION OF THE PREFERRED EMBODIMENT

Figure 1:
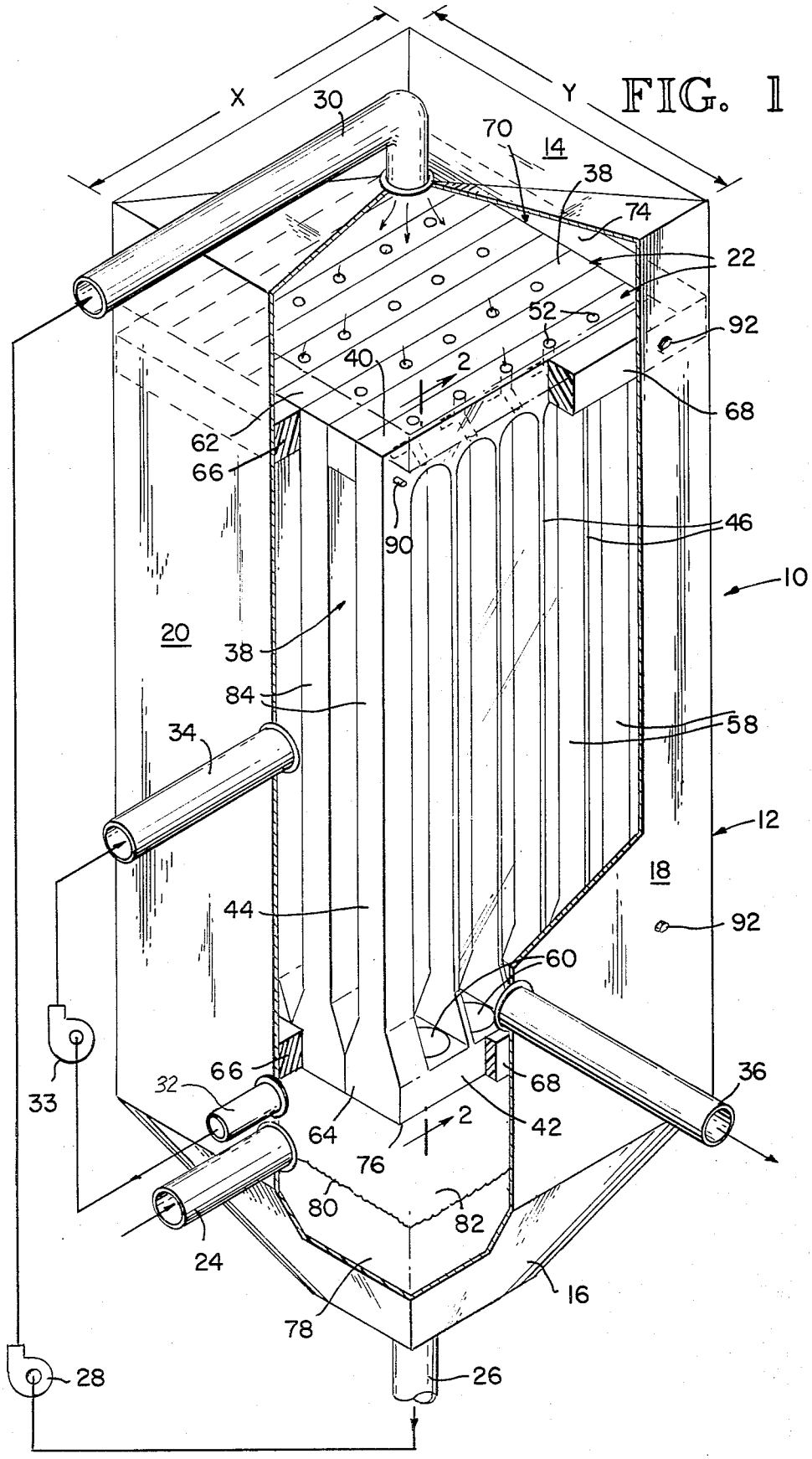
FIG. 1 is an isometric view illustrating the heat exchange apparatus of the present invention.

Since the present invention is particularly adapted for a large scale operation of converting saline water to fresh water, the following description will be directed particularly toward that application. However, it is to be understood that within the broader aspects of the present invention, the present invention could be utilized in other related applications, especially for liquids that are corrosive to metal heat exchange condensers.

With reference to FIG. 1, the heat exchange apparatus 10 comprises a closed box-like housing 12, having a top wall 14, a bottom wall 16, front and rear walls 18, and side walls 20. Contained within the housing 10 are a plurality of modular panel units 22. The particular configuration and arrangement of these panel units 22 in accomplishing the heat exchange function in the present invention are considered to be particularly critical, and these will be described in detail later herein.

There is an inlet conduit 24 leading into the lower portion of one side wall 20, and it is through this conduit 24 that there is delivered into the apparatus 10 the fluid medium from which evaporation is to take place. In the particular application of the desalinization process described herein, it is brine that is fed into the lower part of the housing 12 through this conduit 24. At the lower end of the housing 12 is a brine outlet conduit 26 which directs the brine to a recirculating pump 28 which in turn directs the brine to an upper inlet conduit 30 leading into the top wall 14 of the housing 12.

A steam outlet 32 conduit is positioned in the side wall 20 moderately above the inlet conduit 24. Steam which is evaporated from the brine is directed by this conduit 32 through a compressor 33 which pressurizes the steam to a moderate level (e.g. three psi gauge) and directs it through a steam inlet conduit 34 which leads into the housing 12 at about the mid height thereof. Finally, there is a condensate outlet conduit 36, through which the condensate (i.e. portable water) is directed from the apparatus 10.

As indicated previously herein, the particular configuration and arrangement of the modular panel units 22 are considered to be especially significant in the present invention. In describing these units 22, the apparatus 10 will be considered as having a vertical axis, a horizontal "X" axis extending between the housing side walls 20 so as to be parallel to the front and rear walls 18, and a horizontal "Y" axis extending between the front and rear walls 18 so as to be perpendicular to the "X" axis.

Each panel unit 22 comprises a perimeter frame 38, made up of a top member 40, bottom member 42 and two vertical side members 44. Extending vertically between the top and bottom members 40 and 42 are a plurality of spacing members 46, positioned at regularly spaced intervals along the lateral "X" axis of the panel 22. Each spacing member 46 has the general configuration of a thin elongate slat with the width dimension of the spacing member 46 being parallel to the "Y" axis. The front face of the perimeter frame 38 and the front edges of the spacing members 46 lie in substantially the same vertical plane, and in a like member the back face of the perimeter frame 38 and the back edges of the spacing members 46 also lie in a single vertical plane spaced moderately from the front plane.

A pair of thin film plastic sheets 48 are placed over the front and rear faces of each panel unit 22. The edge portions of each sheet 48 are secured around the entire perimeter frame 38, so as to totally enclose the area within the perimeter frame 38. Thus, as can be seen more clearly in FIG. 3, the two sheets 48 cooperate with the spacing members 46 to provide a plurality of vertically aligned passageways 50. There is formed in the top frame member 40 a plurality of distributor ports 52, with each port 52 being positioned above a related passageway 50. Each port 52 has a pair of diverging outlets 54 which direct the flow of brine into the port 52 against the inner surfaces 56 of the sheet portions 58 that define the related passageway 50.

The bottom perimeter frame member 42 is formed with a plurality of openings 60. In the particular arrangement shown herein, there is one large opening 60 for each passageway 50. These openings 60 are made sufficiently large to provide not only for the outflow of brine which descends as a falling film down the surfaces 56, but also to provide for the outflow of steam which evaporates from the brine within the passageways 50.

As indicated earlier, the panels 22 are vertically aligned with their width dimensions parallel to the horizontal "X" axis. The panels 22 are positioned one behind the other in a manner to be spaced from one another a moderate distance along the lateral "Y" axis. This spacing is conveniently accomplished by providing upper spacing blocks 62 between adjacent upper frame members 40, and enlarged lower frame members 42 which are positioned against each other in side by side relationship, as at 64. This construction can best be seen in FIG. 4.

So that the pressurized steam which enters into the housing 12 through the inlet conduit 34 can circulate freely in the area between the panel units 22, there are a pair of side spacing blocks 66 positioned between the upper and lower side edges of the panel units 22 adjacent the side wall 20 at which the steam inlet 34 is located. Also, there are front and rear spacing blocks 68 located at the upper and lower edge portions of the front and rear panel units 22, with these spacing blocks 68 positioning the front and rear panel units 22 a moderate distance away from the front and rear housing wall 18.

It will be noted that the upper spacing blocks 62, along with the upper side spacing block 66 and upper front and rear spacing blocks 68, form with the top frame members 40 a partition 70 which extends across the entire upper portion of the housing 12. To insure that this partition is liquid impervious, the various spacing blocks 62–68 are provided with partition 70 along with the upper portions of the front, suitable seals 72. Thus, this rear and side housing wall 18–20, form a fluid tight upper chamber 74 to receive the brine from the upper inlet conduit 30 and distribute this brine through the various ports 52 that are formed in the upper portion of the panel units 22.

In like manner, the lower side spacing block 66 and lower front and rear spacing blocks 68, along with the lower frame members 42, form a lower partition 76. Also the various lower spacing blocks 66–68 are provided with suitable seals 72. The lower portion of the housing 12 forms a sump 78 which receives the brine which is recirculated through the apparatus 10. Above the brine level 80 in the sump 78 and below the lower partition 76 is an area 82 where there is collected the steam which evaporates from the falling liquid film in the passageways 52 and passes down through the openings 60. The steam collected in this area 82 is directed to the steam outlet conduit 32, to be pressurized by the compressor 33 and then be fed through the steam inlet conduit 34 into the interior of the housing 12. The area between the panel units 22, bounded on the upper and lower sides by the upper and lower partitions 70 and 76, respectively, is the steam condensate area 84. Pressurized steam in this ara 84 forms as condensate on the outer surfaces 86 of the various sheet portions 58.

The area immediately above the lower partition 76 and between the lower edges of the panel units 22 serves as a condensate collecting area 88. The potable water which forms in this area 88 is taken out through the outlet conduit 36.

To review the operation of the apparatus 10, brine is initially introduced through the inlet conduit 24 into the sump 78. The brine flows through the outlet conduit 26 to a recirculating pump 28 which directs the brine through the top inlet conduit 30 into the upper distribution chamber 74. The brine flows from the chamber 74 into the many distributor ports 52 to be discharged through the diverging outlets 54 as a thin film on the inner surface 56 of the sheet portions 58 that form the vertical passageways. The brine descends as a thin falling film flowing down the inner surfaces 56 of the sheet portions 58 and passes out the lower openings 60 back to the sump 78.

Steam that is formed in the passageways 50 within the panel units 22 passes through the lower openings 60 into the area 82 above the brine level 80. This steam is directed through the steam outlet conduit 32 to be pressurized by the compressor 33 and directed into the steam condensate area 84. The steam is pressurized to the extent that its temperature is moderately higher (e.g. 1° to 20° F.) than the brine. Thus, the steam forms as condensate on the outer surfaces 86 of the sheet portions 58, with the heat passing through these sheet portions 58 to the brine to cause steam to evaporate from the brine that forms the falling films on the inner surfaces 56 of the sheet portions 58. The condensate which forms on the outer surfaces 86 of the sheet portions 58 collects in the area immediately above the lower partition 76 and is discharged through the condensate outlet 36.

Since the steam in the condensing area 84 is pressurized to a moderate extent above atmospheric pressure (e.g. three p.s.i. gauge), the sheet portions 58 tend to deflect inwardly to assume a moderately rounded condition. This can thus be seen with reference to FIG. 3. However, the spacing members 46 maintain the sheet portion 58 at an adequate distance from each other so that the desired cross-sectional area of the passageways 50 is maintained.

From the foregoing description, it can be readily appreciated that the individual modular panel units 22 can be provided as separate modular units which can very easily be assembled and disassembled at various locations. A convenient means of assembly is shown herein by providing the four corner portions of each perimeter frame 38 with through holes, and also providing the upper and lower spacing blocks 62 and 64 with matching through holes. Retaining rods 90 can be inserted through these holes, with nuts 92 being threaded onto the end of the rods to press the panel units and the spacing blocks 62 and 64 securely against one another.

In a typical commercial installation, while not necessarily being limited to these dimensions, the vertical dimension of each of the panel units 22 could be between five to fifty feet, and the width dimensions between about one to six feet. Typically, the sheets 46 could be made of 2–4 mill Tedlar (a trademark identifying a polyvinylfluoride type plastic material), or a heat resistant polyethelene or propylene or any thin membrane, consistent with the operational requirements of the apparatus. The thickness of the sheets can be between about 0.0005 to 0.02 inch, and desirably between about 0.002 to 0.006 inch, with a thickness of 0.004 inch being suitable for a number of applications. The spacing between the spacing members 46 (i.e. the spacing along the lateral "X" axis) would be between about one to three inch, and desirably between about 1½ to 2½ inch, this dimension being illustrated at "a" in FIG. 3. The width dimension of the spacing elements 46 (indicated at "b" in FIG. 3) would be between about one to three inch and desirably between about 1½ to 2½ inch.

What is claimed:

1. A method of accomplishing heat exchange between a first liquid medium and a second vaporized medium which is to be condensed by being placed in heat exchange relationship with said first liquid medium, said method comprising:

a. providing a heat exchange structure having a heat exchange section with a vertical axis, a horizontal "X" axis, and a horizontal "Y" axis perpendicular to the "X" axis, said heat exchange section comprising a plurality of heat exchange panel units, each of said panel units comprising:

1. a mounting frame lying generally in a plane aligned with the vertical axis and the "X" axis, said mounting frame comprising a perimeter portion and a plurality of spacing elements spaced from said perimeter portion and from one another at generally regular intervals along said "X" axis, each of said spacing elements being vertically aligned and also having a substantial alignment component along said "Y" axis 2. a pair of thin film sheets having inner and outer surfaces, and positioned on opposite sides of said mounting frame, with the inner surfaces of the sheets defining with the frame vertical passageways within the panel unit, said panel units positioned adjacent one another so as to be spaced moderately from one another at generally regular intervals along said "Y" axis, with each adjacent pair of panel units defining a condensing area therebetween, b. directing a pressurized gaseous medium into the condensing areas between said panel unit, c. directing a liquid evaporating medium as liquid films onto the upper ends of the inner surfaces of said sheets, whereby heat exchange is able to take place between said two mediums across said sheets.

2. The method as recited in claim 1, wherein said vertically extending spacing elements, are spaced laterally from one another along the "X" axis at a distance of about 1 to 3 inches, and said spacing elements having a dimension along said "Y" axis between about 1 to 3 inch.

3. The method as recited in claim 1, wherein said vertically extending spacing elements are spaced horizontally from one another along the "X" axis at a distance of about 1½ to 2½ inches, and said spacing elements having a dimension along said "Y" axis between about 1½ to 2½ inch.

4. A heat exchange apparatus for use as condenser-/evaporator heat exchanger, said apparatus comprising:

a. a heat exchange section having a vertical axis, a horizontal "X" axis and a horizontal "Y" axis perpendicular to the "X" axis, said heat exchange section comprising a plurality of heat exchange panel units, each of said panel units comprising:

1. a mounting frame lying generally in a plane aligned with the vertical axis and the "X" axis, said mounting frame comprising a perimeter portion and a plurality of spacing elements spaced from said perimeter portion and from one another at generally regular intervals along said "X" axis, each of said spacing elements being vertically aligned and also having a substantial alignment component along said "Y" axis
2. a pair of thin film sheets having inner and outer surfaces, and positioned on opposite sides of said mounting frame, with the inner surfaces of the sheets defining with the frame vertical passageways within the panel unit, b. said panel units positioned adjacent one another so as to be spaced moderately from one another at generally regular intervals along said "Y" axis, with each adjacent pair of panel units defining a condensing area therebetween, c. means to direct a pressurized gaseous condensing medium into the condensing areas between said panel units, and, d. means to direct a liquid evaporating medium as liquid films onto the upper ends of the inner surfaces of said sheets, whereby heat exchange is able to take place between said two mediums across said sheets.

5. The apparatus as recited in claim 4, wherein each of said frame portions comprises upper, bottom and side members, each of said upper members having a plurality of inlet ports, each leading into a related passageway to permit said liquid medium to be directed into such passageways, each of said bottom members being provided with outlet ports, each leading from a related passageway to permit outflow of said liquid medium.

6. The apparatus as recited in claim 4, wherein there are a plurality of spacing blocks positioned between the panel units at least at one of the upper and lower ends of said panel units, said spacing blocks forming with said panel units a partition to confine the condensing medium located in the areas between adjacent pairs of said panel units.

7. The apparatus as recited in claim 4, wherein there are spacing blocks at the upper end of said panel units, said spacing blocks forming with upper perimeter frame member portions forming an upper partition, and with lower frame member portions abutting against one another to form a lower partition, said partitions containing the condensing medium in the areas between the panel units.

8. The apparatus recited in claim 4, wherein said vertically extending spacing elements are spaced from one another along the "X" axis at a distance between about 1 to 3 inches, and said spacing elements having a dimension along said "Y" axis between about 1 to 3 inch.

9. The apparatus as recited in claim 4, wherein said vertically extending spacing elements are spaced from one another along the "X" axis at a distance between about 1½ to 2½ inches, and said spacing elements having a dimension along said "Y" axis between about 1½ to 2½ inch.

* * * * *